US009814123B2

(12) United States Patent
Van De Sluis et al.

(10) Patent No.: US 9,814,123 B2
(45) Date of Patent: Nov. 7, 2017

(54) APPARATUS AND METHODS FOR ACTIVATABLE LIGHTING DEVICES

(71) Applicant: PHILIPS LIGHTING HOLDING B.V., Eindhoven (NL)

(72) Inventors: Bartel Marinus Van De Sluis, Eindhoven (NL); Julian Charles Nolan, Pully (CH); Tim Dekker, Eindhoven (NL); Alexander Henricus Waltherus Van Eeuwijk, Eindhoven (NL); Philip Steven Newton, Waalre (NL); Hilbrand Vanden Wyngaert, Grobbendonk (BE); Dzmitry Viktorovich Aliakseyeu, Eindhoven (NL); Heiko Pelzer, Erkelenz (DE); Ramon Antoine Wiro Clout, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 66 days.

(21) Appl. No.: 14/782,483

(22) PCT Filed: Apr. 2, 2014

(86) PCT No.: PCT/IB2014/060382

§ 371 (c)(1),
(2) Date: Oct. 5, 2015

(87) PCT Pub. No.: WO2014/162279

PCT Pub. Date: Oct. 9, 2014

(65) Prior Publication Data

US 2016/0073474 A1 Mar. 10, 2016

(30) Foreign Application Priority Data

Apr. 5, 2013 (EP) ..... 13162549

(51) Int. Cl.
*H05B 37/02* (2006.01)

(52) U.S. Cl.
CPC ..... *H05B 37/029* (2013.01); *H05B 37/0272* (2013.01)

(58) Field of Classification Search
None
See application file for complete search history.

(56) References Cited

U.S. PATENT DOCUMENTS 6,909,921 B1 6/2005 Bilger
7,123,140 B1 * 10/2006 Denes ..... G08C 17/02 340/538.11

(Continued)

FOREIGN PATENT DOCUMENTS

JP 2004086514 A 3/2004
JP 2005215789 A 8/2005

(Continued)

*Primary Examiner* — Crystal L Hammond

(57) ABSTRACT

Methods, apparatus and computing devices are described herein for activatable lighting devices. In various embodiments, a composition of a lighting system may be ascertained based at least in part on a database (851, 951) of one or more lighting device records associated with one or more lighting devices (100, 600, 700, 800*a*, 800*b*, 900, 1000*a*, 1000*b*, 1000*c*) of the lighting system. In various embodiments, it may be determined, based on the ascertained composition, that a predetermined criterion is satisfied. In various embodiments, a communication may be issued in response to the determination. The communication may be configured to facilitate activation of a deactivated lighting device function of a lighting device associated with the lighting system.

20 Claims, 7 Drawing Sheets

(56) References Cited

U.S. PATENT DOCUMENTS

| | | | | |
|---|---|---|---|---|
| 2003/0222588 | A1 | 12/2003 | Myron et al. | |
| 2004/0052076 | A1 | 3/2004 | Mueller et al. | |
| 2007/0206375 | A1 | 9/2007 | Piepgras et al. | |
| 2010/0276482 | A1* | 11/2010 | Raihi | G07F 15/003 235/375 |
| 2011/0199004 | A1 | 8/2011 | Henig et al. | |
| 2011/0202151 | A1 | 8/2011 | Covaro et al. | |
| 2011/0298380 | A1 | 12/2011 | Tsai | |
| 2011/0316451 | A1 | 12/2011 | Loveland et al. | |
| 2012/0080944 | A1* | 4/2012 | Recker | H02J 9/02 307/25 |
| 2013/0271004 | A1* | 10/2013 | Min | H05B 33/0842 315/112 |

FOREIGN PATENT DOCUMENTS

| | | | |
|---|---|---|---|
| KR | 20100112955 | A | 10/2010 |
| WO | 2008029323 | A1 | 3/2008 |
| WO | 2010067246 | A1 | 6/2010 |
| WO | 2011033409 | A1 | 3/2011 |
| WO | 2011092619 | A1 | 8/2011 |
| WO | 2011120190 | A1 | 10/2011 |
| WO | 2012020081 | A1 | 2/2012 |
| WO | 2012112813 | A2 | 8/2012 |

* cited by examiner

Fig. 8
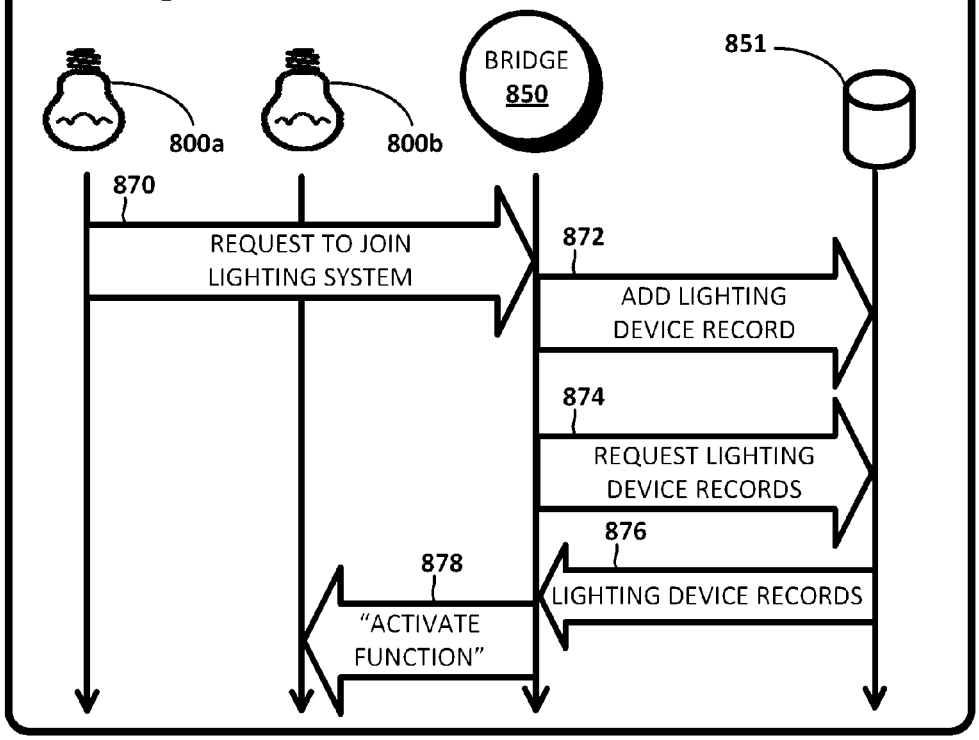
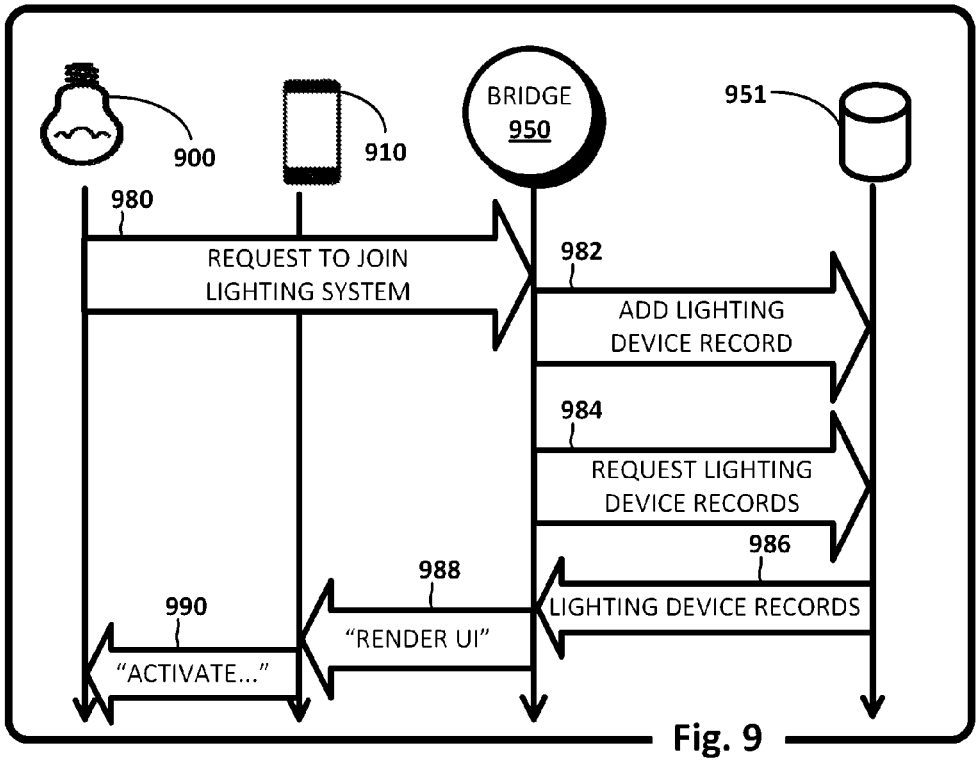
Fig. 9

1100

APPARATUS AND METHODS FOR ACTIVATABLE LIGHTING DEVICES

CROSS-REFERENCE TO PRIOR APPLICATIONS

This application is the U.S. National Phase application under 35 U.S.C. §371 of International Application No. PCT/IB2014/060382, filed on Apr. 2, 2014, which claims the benefit of European Patent Application No. EP 13162549.3, filed on Apr. 5, 2013. These applications are hereby incorporated by reference herein.

FIELD OF THE INVENTION

The present invention relates to lighting, particularly to activatable lighting devices, to lighting fixtures comprising such lighting devices and to systems and methods for configuring such lighting devices.

BACKGROUND

Digital lighting technologies, i.e., illumination based on semiconductor light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications. Some of the fixtures embodying these sources feature a lighting module, including one or more LEDs capable of producing different colors, e.g., red, green, and blue, as well as a processor for independently controlling the output of the LEDs in order to generate a variety of colors and color-changing lighting effects, for example, as discussed in detail in U.S. Pat. Nos. 6,016,038 and 6,211,626, incorporated herein by reference.

Retail outlets may stock a number of different color temperature variants of LED lamps, and each of the color temperature variants may be offered in a number of different power ratings. Stocking each of the available color temperature variants in each of the power ratings would entail significant inventory cost, and would complicate and reduce the efficiency of the associated supply chain. This is less of an issue for configurable LED lamps whose color temperature can be configured after purchase, e.g. as disclosed in patent publication no. WO 2011/033409 A1, since obviously such lamps do not have different color temperature variants. However, such configurable LED lamps have a higher purchase price than the non-configurable LED lamps.

Today's LED lamps, particularly configurable LED lamps, are expensive compared with their traditional counterparts. Therefore LED lamps are unaffordable for some potential users, such as potential users in developing countries. Furthermore, the small size and relatively high purchase price of LED lamps, particularly the configurable LED lamps, makes them attractive to shop-lifters.

SUMMARY

Disclosed herein are various aspects and embodiments which address at least one of the shortcomings noted above.

Generally, in one aspect, a computing device may include one or more processors, a communication interface coupled with the one or more processors, and memory. The memory may store instructions that, in response to execution of the instructions by the one or more processors, cause the one or more processors to: ascertain, based at least in part on a database of one or more lighting device records associated with one or more lighting devices of a lighting system, a composition of the lighting system; determine, based on the ascertained composition, that a predetermined criterion is satisfied; and issue, via the communication interface in response to the determination, a communication configured to facilitate activation of a deactivated lighting device function of a lighting device associated with the lighting system.

In various embodiments, the predetermined criterion comprises a threshold number of lighting devices present in the lighting system. In various embodiments, the predetermined criterion comprises a threshold number of lighting devices associated with a particular entity present in the lighting system. In various embodiments, the predetermined criterion comprises a threshold number of lighting devices having a particular lighting device function activated that are present in the lighting system. In various embodiments, the particular lighting device function comprises a baby monitoring function, a security monitoring function, a user-input detecting function, an intercom function, a Wi-Fi repeater function, a wake up light effect function, a nightlight function, an info-light function, an environmental parameter-sensing function, an audio rendering or recording function, or a speech recognition function.

In various embodiments, the memory further stores the database of one or more lighting device records. In various embodiments, the memory further stores instructions that, in response to execution of the instructions by the one or more processors, cause the one or more processors to transmit the communication to a remote computing device, and wherein the communication facilitates user operation of the remote computing device to activate the deactivated lighting device function. In various versions, the remote computing device comprises a mobile computing device, and the communication is configured to cause the mobile computing device to render a user interface operable by a user to activate the deactivated lighting device function. In various versions, the remote computing device may be a lighting system bridge that controls the lighting system or a lighting device associated with the lighting system.

In various embodiments, the memory further stores instructions that, in response to execution of the instructions by the one or more processors, cause the one or more processors to transmit the communication to the lighting device associated with the lighting system or a lighting system bridge that controls the lighting system, and wherein the communication comprises a command to activate the deactivated lighting device function. In various versions, the memory further stores instructions that, in response to execution of the instructions by the one or more processors, cause the one or more processors to render a user interface operable by a user to purchase activation of the deactivated lighting device function of the lighting device. In various versions, the memory further stores instructions that, in response to execution of the instructions by the one or more processors, cause the one or more processors to update the database to reflect activation of the deactivated lighting device function.

In another aspect, a computer-implemented method may include: obtaining, by a mobile computing device via a wireless communication interface, an indication of one or more deactivated lighting device functions of a lighting device; receiving, by the mobile computing device via a user interface of the mobile computing device, a user instruction to select and activate a deactivated lighting device function of the lighting device; and issuing, by the mobile computing device via the wireless communication interface, a communication configured to cause activation of the deactivated lighting device function of the lighting device.

In various embodiments, the issuing comprises transmitting, by the mobile computing device to the lighting device or a lighting system bridge in communication with the lighting device, a command to activate the deactivated lighting device function of the lighting device. In various embodiments, the method further includes rendering, on a touch screen of the mobile computing device, a user interface operable by a user to purchase activation of the deactivated lighting device function of the lighting device. In various versions, the user interface is further operable by the user to select a time interval for which the deactivated lighting device function will be activated. In some embodiments, the issuing may include transmitting, by the mobile computing device to the lighting device or a lighting system bridge in communication with the lighting device, commands to activate the deactivated lighting device function of the lighting device and then deactivate the lighting device function after passage of the time interval.

In various embodiments, obtaining the indication of one or more deactivated lighting device functions of the lighting device comprises receiving, by the mobile computing device directly from the lighting device, the indication of one or more deactivated lighting device functions of the lighting device. In various embodiments, obtaining the indication of one or more deactivated lighting device functions of the lighting device comprises obtaining, by the mobile computing device from a lighting system bridge in communication with the lighting device, the indication of one or more deactivated lighting device functions of the lighting device.

In various embodiments, obtaining the indication of one or more deactivated lighting device functions of the lighting device comprises obtaining, from a database of one or more lighting device records associated with one or more lighting devices of a lighting system, a composition of the lighting system. In various versions, the database is stored in memory of the mobile computing device.

In another aspect, a lighting device may include: one or more LED-based light sources; a communication interface; and a controller operably coupled with the one or more LED-based light sources and the communication interface. The controller may be configured to: ascertain, based at least in part on a database of one or more lighting device records associated with one or more lighting devices of a lighting system with which the lighting device is associated, a composition of the lighting system; determine, based on the ascertained composition, that a predetermined criterion is satisfied; and activate a deactivated lighting device function of the lighting device in response to the determination.

In various embodiments, the controller is further configured to provide, to another lighting device via the communication interface, a command to activate the same deactivated lighting device function on the another lighting device. In various embodiments, the controller is further configured to deactivate the lighting device function after a predetermined time interval. In various embodiments, the controller is further configured to deactivate the lighting device function after a predetermined time interval unless a lighting device function renewal communication is received via the communication interface during the time interval.

In various embodiments, the controller is further configured to deactivate the lighting device function upon determination that a network characteristic of the lighting device has been altered. In various embodiments, the controller is further configured to deactivate the lighting device function upon determination that the composition of the lighting system no longer satisfies the predetermined criterion. In various embodiments, the controller is further configured to deactivate the lighting device function upon determination that a state of a dongle has been altered.

In various embodiments, the controller is further configured to: provide, to a computing device via the communication interface, an indication of one or more deactivated lighting device functions of the lighting device; receive, via the communication interface, a command to activate the deactivated lighting device function; and activate the deactivated lighting device function in response to the command.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyroluminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The term "color temperature" generally is used herein in connection with white light, although this usage is not intended to limit the scope of this term. Color temperature essentially refers to a particular color content or shade (e.g., reddish, bluish) of white light. The color temperature of a given radiation sample conventionally is characterized according to the temperature in degrees Kelvin (K) of a black body radiator that radiates essentially the same spectrum as the radiation sample in question. Black body radiator color temperatures generally fall within a range of approximately 700 degrees K (typically considered the first visible to the human eye) to over 10,000 degrees K; white light generally is perceived at color temperatures above 1500-2000 degrees K.

Lower color temperatures generally indicate white light having a more significant red component or a "warmer feel," while higher color temperatures generally indicate white light having a more significant blue component or a "cooler feel." By way of example, fire has a color temperature of approximately 1,800 degrees K, a conventional incandescent bulb has a color temperature of approximately 2848 degrees K, early morning daylight has a color temperature of approximately 3,000 degrees K, and overcast midday skies have a color temperature of approximately 10,000 degrees K. A color image viewed under white light having a color temperature of approximately 3,000 degree K has a relatively reddish tone, whereas the same color image viewed under white light having a color temperature of approximately 10,000 degrees K has a relatively bluish tone.

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "lighting device" is used herein to refer generally to a lighting unit and/or lighting fixture (e.g., a luminaire) that includes one or more light sources of same or different types. A given lighting device may have any one or more of a variety of mounting arrangements for the light source(s), enclosure/housing arrangements and shapes, optics, power-supply circuitry, control circuitry and/or electrical and mechanical connection configurations. A LED lamp, e.g. the "Philips Hue" lamp, is one example of such a lighting device.

The term "controller" is used herein generally to describe various apparatus relating to the operation of one or more light sources. A controller can be implemented in numerous ways (e.g., such as with dedicated hardware) to perform various operations discussed herein. A "processor" is one example of a controller which employs one or more microprocessors that may be programmed using software (e.g., microcode) to perform various operations discussed herein. A controller may be implemented with or without employing a processor, and also may be implemented as a combination of dedicated hardware to perform some operations and a processor (e.g., one or more programmed microprocessors and associated circuitry) to perform other operations. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the operations discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

The term "user interface" as used herein refers to an interface between a human user or operator and one or more devices that enables communication between the user and the device(s). Examples of user interfaces that may be employed in various implementations of the present disclosure include, but are not limited to, switches, potentiometers, buttons, dials, sliders, a mouse, keyboard, keypad, various types of game controllers (e.g., joysticks), track balls, display screens, various types of graphical user interfaces (GUIs), touch screens, microphones and other types of sensors that may receive some form of human-generated stimulus and generate a signal in response thereto.

The term "lighting device function" as used herein refers to any routine or state machine performed by a lighting device, by a lighting unit installed in a lighting fixture, or by a lighting fixture. Lighting device functions may include but are not limited to emitting predetermined lighting scenes, performing a baby monitor function, emitting light in response to detection of motion, becoming touch-, sound- or motion-sensitive, emitting light having various characteristics (e.g., hue, saturation, color temperature, coded light, various brightness levels, aesthetically pleasing transitions between lighting effects, etc.), performing as a Wi-Fi repeater, acting as an intercom, and so forth. Other lighting device functions may include but are not limited to a security monitoring function, a wake up light effect function, a nightlight function, an info-light function, a user input detection function (e.g., touch, sound, etc.), an environmental parameter-sensing function (e.g., light, temperature, humidity, barometric pressure, noise, etc.), an audio rendering and/or recording function, a speech recognition function, and so forth.

A lighting device function may include emission of a dynamic lighting sequence as well. For instance, a presence-simulating lighting device function may include emission of a predetermined lighting sequence to give the impression that someone is home (e.g., by emitting light to simulating someone walking around or even emitting light to mimic a television). A "deactivated" lighting state function may refer to a lighting function that is built into a lighting device, but that is not performable until activated. A deactivated lighting function may be "activated" in response to various events and stimuli, as will be discussed herein.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

FIGS. 6-10 illustrate various communications that may occur between lighting devices configured with selected aspects of the present disclosure and various other components, in accordance with various embodiments.

DETAILED DESCRIPTION

Figure 1:
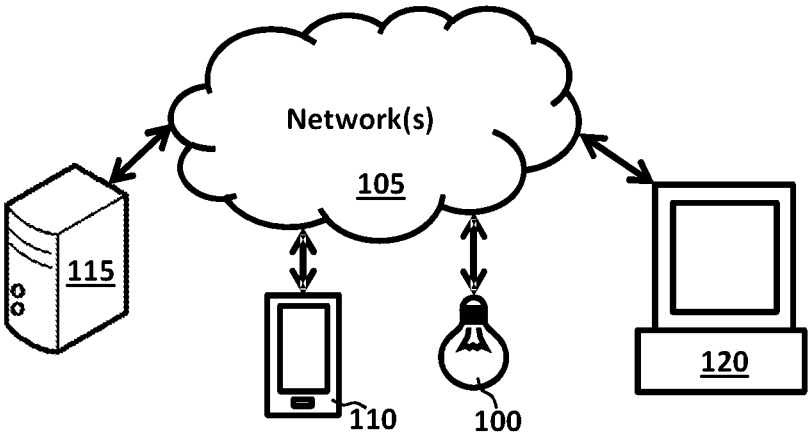
FIG. 1 schematically shows a system for activating a device for illuminating an environment, in accordance with an embodiment of the invention.

As shown in FIG. 1, in an embodiment a lighting device 100 is communicatively connected to one or more networks 105. Also connected to the network(s) 105 are: a wireless communications device 110, such as a smartphone or a tablet computer; one or more servers 115; and a point of sale (PoS) terminal 120. The respective connections between these devices and the network(s) 105 may, for example, be one or more of Zigbee Light Link connections, Bluetooth connections, WiFi connections, wired Ethernet connections, power line communication connections and the like. Each of the devices 100, 110, 115, 120 may be able to communicate with any one or more of the other devices via the network(s) 105.

Figure 2:
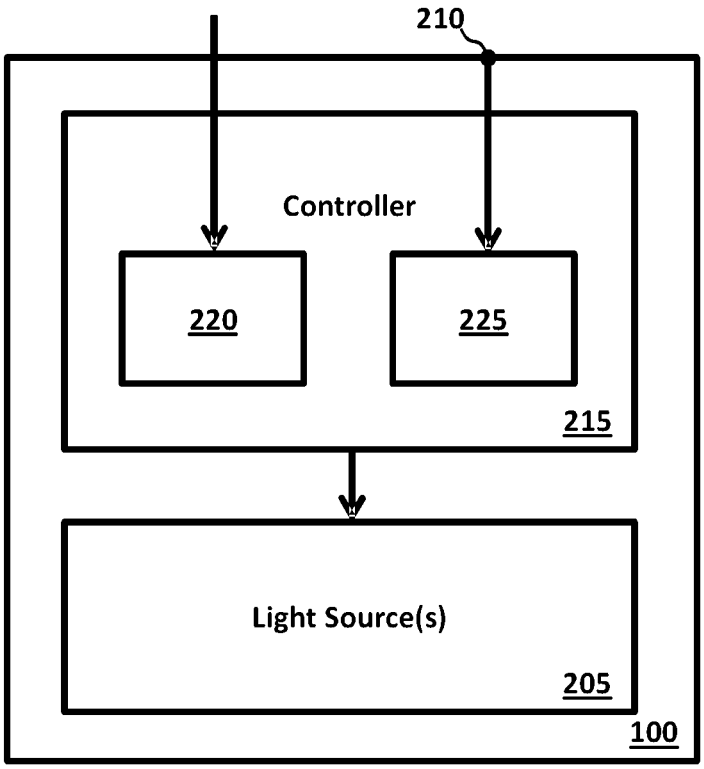
FIG. 2 schematically shows some of the main components of the device of FIG. 1, according to an embodiment of the invention.

As shown in FIG. 2, in an embodiment the lighting device 100 comprises one or more light sources 205, an input for receiving power (hereinafter, the "power input 210") and a controller 215. The controller 215 is coupled to the power input 210 and to the light source(s) 205.

The light source(s) 205 may comprise any one or more of a variety of radiation sources, including, but not limited to, LED-based sources, incandescent sources (e.g., filament lamps, halogen lamps), fluorescent sources, phosphorescent sources, high-intensity discharge sources (e.g., sodium vapor, mercury vapor, and metal halide lamps), lasers, or other types of electroluminescent light sources.

The power input 210 may comprise any one or more of a variety of suitable (known) connectors, such as conventional lamp connectors like an Edison screw base, a bayonet-style base, a bi-pin connector (or the like), a connector for power-over-Ethernet, or any other suitable connector.

As shown in FIG. 2, the controller 215 comprises a communication interface in the form of a receiver 220 for receiving an activation (explained below) from outside the lighting device 100. The receiver 220 may comprise an antenna and associated circuitry for receiving and decoding WiFi signals, Bluetooth signals, Zigbee Lightlink signals or the like. Additionally or alternatively, the receiver 220 may comprise a connector and associated circuitry for receiving and decoding signals by wire, e.g. via an Ethernet cable, a USB cable or the like.

The controller 215 further comprises a power supply unit 225, which is connected to and receives power from the power input 210. The power supply unit 225 is arranged to generate, under the control of the controller 215, drive signals for the controller 215 to drive the light source(s) 205.

In overview, the controller 215 is configured to maintain the lighting device 100 in an inoperative state or in a functionally-limited state until an activation is received. In response to receiving the activation, the controller 215 will transition the lighting device 100 into an operative state in which the controller 215 drives the light source(s) 205 according to one or more preset parameters and/or according to one or more user-selected parameters. Methods of activating the lighting device 100 will be explained below with reference to FIGS. 3 and 4.

Figure 3:
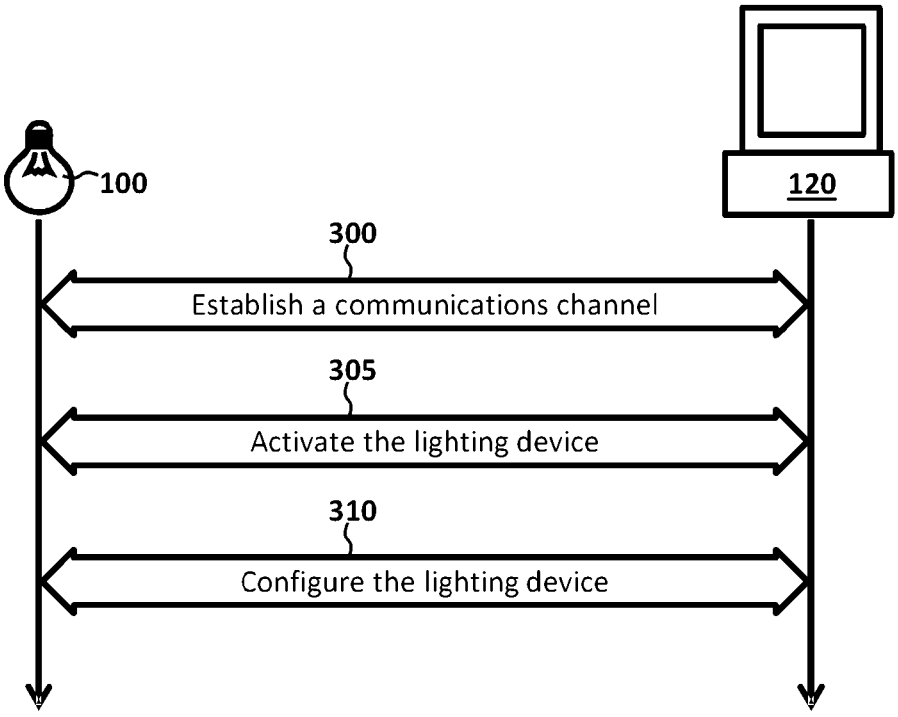
FIG. 3 illustrates the communication between a point of sale terminal and the device of FIGS. 1 and 2, according to an embodiment of the invention.

As shown in FIG. 3, in some embodiments the lighting device 100 is activated at the PoS terminal 120. For example, a customer may purchase the lighting device 100 at a shop via the PoS terminal 120. Once the purchase has been completed, the PoS terminal 120 activates and optionally configures the lighting device 100.

As a preliminary step, the PoS terminal 120 obtains (e.g. from memory or via communication with another device or apparatus) information for activating the lighting device 100. In order to obtain the information, the PoS terminal 120 may be configured to decoded a QR code on the lighting device 100 or its packaging, and to obtain therefrom a memory address, logical address (e.g. a uniform resource identifier (URI), a MAC address and/or an IP address) or the like which indicates where the information can be obtained from.

In this embodiment, the lighting device 100 is connected to a suitable socket (not shown) of the PoS terminal 120 whereby the PoS terminal 120 powers the lighting device 100 temporarily so that it can activate the lighting device 100. In other embodiments, the PoS terminal 120 may temporarily power the lighting device 100 via inductive coupling and/or capacitive coupling, so the lighting device 100 may remain entirely enclosed in its packaging during activation. The coupling may suffice to power the controller 215, but not necessarily to a sufficient level to enable the power supply unit 225 to drive the light source(s) 205. For instance, in various embodiments (not shown) the controller 215 may comprise a microcontroller and non-volatile memory, both connected to circuitry for receiving electrical power via an inductive and/or capacitive coupling to the PoS terminal 120; the coupling circuitry does not supply electrical power the power supply unit 225. Thus the activation may be performed via the microcontroller and non-volatile memory, using less power than the power supply unit 225 would require in order to drive the light source(s) 205.

In order to activate the lighting device 100, the PoS terminal 120 and the lighting device 100 establish 300 a communications channel whereby they can communicate with one another securely. This is done in a conventional manner, e.g. via an exchange of messages between the PoS terminal 120 and the lighting device 100, which will be readily understood by those skilled in the art without further explanation. The exchange may be via Near Field Communication, for example. As part of establishing 300 the secure communications channel, the PoS terminal 120 establishes that it is authorized to activate the lighting device 100, using the information it obtained in the preliminary step mentioned above.

Having established the secure communications channel, the PoS terminal 120 activates 305 the lighting device 100, thereby causing the lighting device 100 to transition to an operative state from an inoperative state or a functionally-limited state. To do so, the PoS terminal 120 sends an activation to the lighting device 100 over the secure communications channel in a conventional manner, which may involve uni- or bi-directional transmission of message(s). The activation is an encoded command which the lighting device 100 is configured to recognize and decode. The activation, once decoded, is what causes the lighting device 100 to transition to the operative state.

Having activated the lighting device 100, optionally the PoS terminal 120 configures 310 the lighting device 100. For example, at the store the customer may select one or more desired parameters for the lighting device 100, such as a desired hue, a desired saturation or a desired color temperature. The PoS terminal 120 may be capable of configuring the lighting device 100 in accordance with the one or more desired parameters of the customer.

In various embodiments, the PoS terminal 120 configures 310 the lighting device 100 by sending thereto one or more messages indicative of one or more desired parameters of the lighting device 100. The one or more messages may be transmitted over the secure communications channel, or 'in the clear'.

Figure 4:
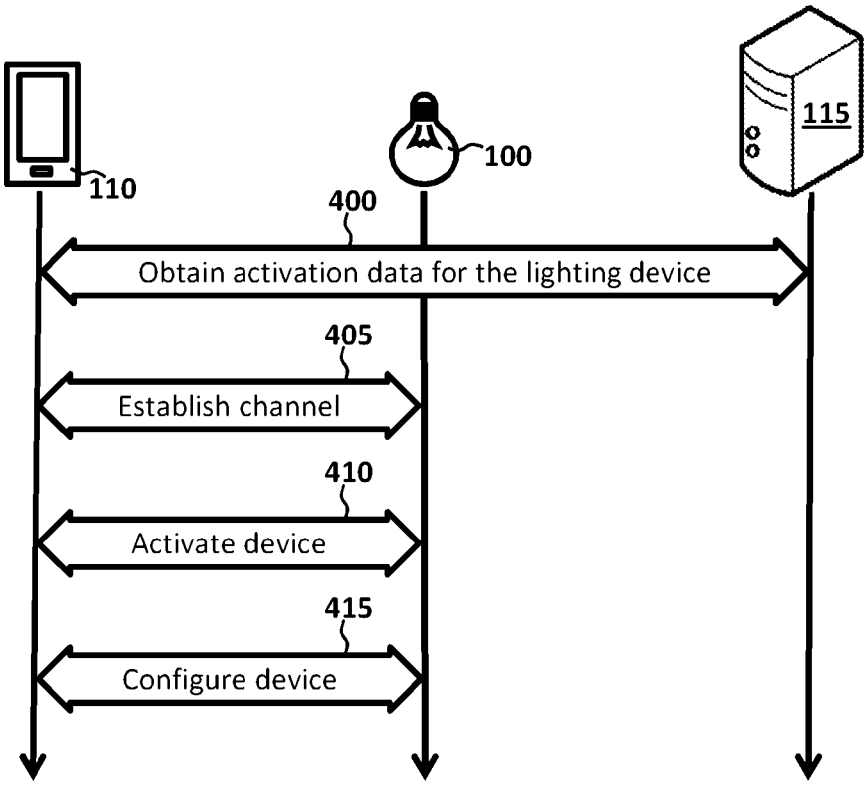
FIG. 4 illustrates the communication between a wireless communications device, a server and the device of FIGS. 1 and 2, according to an embodiment of the invention.

As shown in FIG. 4, in some embodiments a purchaser who has purchased the lighting device 100 may activate it at home via the Internet 105. The purchaser may use his or her wireless communications device 110 for performing the activation.

As a preliminary step, under the control of the purchaser, the wireless communications device 110 may obtain sufficient information to be able to communicate with a server 115 associated with the lighting device 100. For instance, the wireless communications device 110 may, via an integrated camera thereof, capture and decode a QR code displayed on the lighting device 100 and/or its packaging. The decoded QR code may comprise a logical address of the server 115, e.g. a uniform resource identifier (URI), a MAC address and/or an IP address. The wireless communications device 110 is then operable to communicate with the server 115 and thereby obtain activation data for the lighting device 100; obtaining the activation data for the lighting device 100 may require proof-of-purchase details to be supplied to the server 115, e.g. a number, password etc. provided to the purchaser at the time of purchase of the lighting device 100. Following which, the wireless communications device 110 is operable to activate and optionally configure the lighting device 100.

The purchaser may place the lighting device 100 in a socket of a lighting fixture for which it was purchased, wherefrom it will receive the electrical power it needs for operation. Thus the lighting device 100 is in a suitable condition to be activated and optionally configured by the wireless communications device 110.

In order to activate and optionally configure the lighting device 100, the wireless communications device 110 and the lighting device 100 are configured to establish 405 a communications channel whereby they can communicate with one another securely. This may be initiated by the wireless communications device 110; it may be done in a conventional manner, e.g. via an exchange of messages between the wireless communications device 110 and the lighting device 100, which will be readily understood by those skilled in the art without further explanation. The exchange may be via wireless communication, e.g. via a Zigbee Light Link. As part of establishing 405 the secure communications channel, the wireless communications device 110 establishes that it is authorized to activate the lighting device 100, e.g. using known techniques with the activation data it obtained 400 from the server 115.

Having established the secure communications channel, the wireless communications device 110 activates 410 the lighting device 100, thereby causing the lighting device 100 to transition to an operative state from an inoperative state or a functionally-limited state. To do so, the wireless communications device 110 sends an activation to the lighting device 100 over the secure communications channel in a conventional manner, which may involve uni- or bi-directional transmission of message(s). The activation is an encoded command which the lighting device 100 is configured to recognize and decode. The activation, once decoded, is what causes the lighting device 100 to transition to the operative state.

Having activated the lighting device 100, optionally the wireless communications device 110 configures 415 the lighting device 100. For example, the wireless communications device 110 may display on a screen thereof a user interface for the customer to select one or more desired parameters for the lighting device 100, such as a desired hue, a desired saturation or a desired color temperature. The wireless communications device 110 may be capable of configuring the lighting device 100 in accordance with the one or more desired parameters of the customer, as indicated via the user interface. In various embodiments, the wireless communications device 110 configures 415 the lighting device 100 by sending thereto one or more messages indicative of one or more desired parameters of the lighting device 100. The one or more messages may be transmitted over the secure communications channel, or 'in the clear'.

Figure 5:
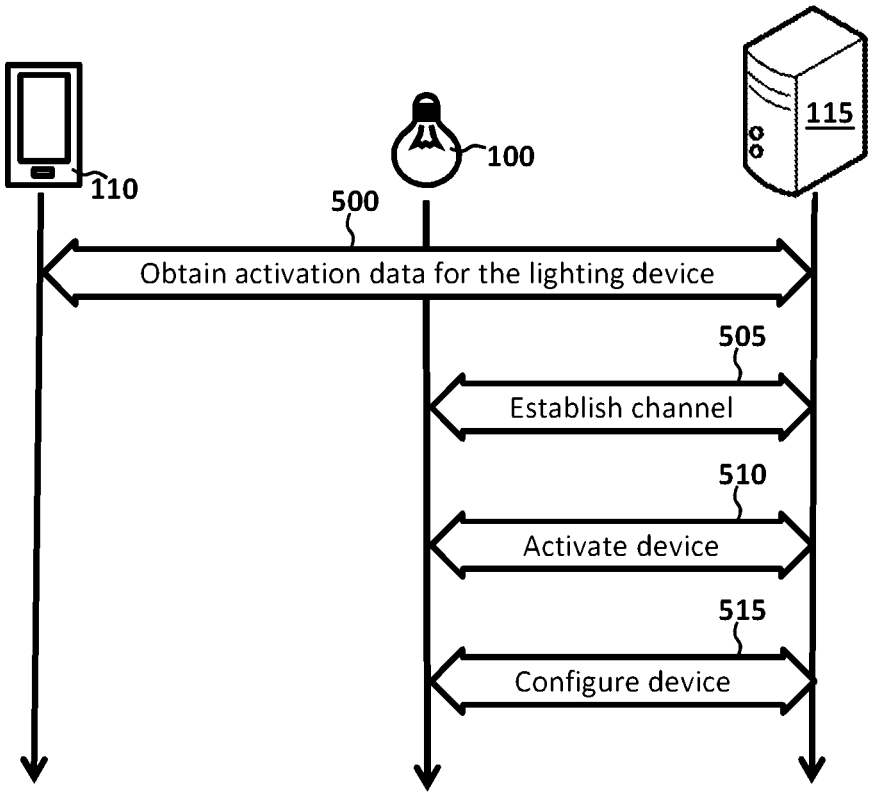
FIG. 5 illustrates the communication between a wireless communications device, a server and the device of FIGS. 1 and 2, according to an embodiment of the invention.

As shown in FIG. 5, in some embodiments a purchaser who has purchased the lighting device 100 may activate it at home via the Internet 105. The purchaser may use his or her wireless communications device 110 for performing the activation. In contrast to the approach depicted in FIG. 4, here a lighting device 100 is activated, and optionally configured, over the Internet by a server.

As a preliminary step, under the control of the purchaser, the wireless communications device 110 may obtain sufficient information to be able to communicate with a server 115 associated with the lighting device 100. For instance, the wireless communications device 110 may, via an integrated camera thereof, capture and decode a QR code displayed on the lighting device 100 and/or its packaging. The decoded QR code may comprise a logical address of the server 115, e.g. a uniform resource identifier (URI), a MAC address and/or an IP address. The wireless communications device 110 is then operable to communicate with, and thereby send proof-of-purchase details to, the server 115. The proof-of-purchase details may comprise, e.g., a number, password etc. provided to the purchaser at the time of purchase of the lighting device 100. The purchaser may need to manually enter the proof-of-purchase details into wireless communications device 110 via a suitable user interface thereof.

Optionally, the wireless communications device 110 may display on a screen thereof a user interface for the customer to select one or more desired parameters for the lighting device 100, such as a desired hue, a desired saturation or a desired color temperature; the wireless communications device 110 may provide the desired parameter(s) to the server 115. Following the preliminary step, the server 115 is configured to activate and optionally configure the lighting device 100.

The purchaser may place the lighting device 100 in a socket of a lighting fixture for which it was purchased, wherefrom it will receive the electrical power it needs for operation. Thus the lighting device 100 is in a suitable condition to be activated and optionally configured by the server 115.

In order to activate and optionally configure the lighting device 100, the server 115 and the lighting device 100 are configured to establish 505 a communications channel whereby they can communicate with one another securely via one or more networks (105), which may comprise the Internet. This may be initiated by the server 115; it may be done in a conventional manner, e.g. via an exchange of messages between the server 115 and the lighting device 100, which will be readily understood by those skilled in the art without further explanation. The exchange may be via a combination of wired and wireless communication, e.g. via a Zigbee Light Link and Internet Protocol communications. As part of establishing 505 the secure communications channel, the server 115 establishes that it is authorized to activate the lighting device 100 using known techniques.

Having established the secure communications channel, the server 115 activates 510 the lighting device 100, thereby causing the lighting device 100 to transition to an operative state from an inoperative state or a functionally-limited state. To do so, the server 115 sends an activation to the lighting device 100 over the secure communications channel in a conventional manner, which may involve uni- or bi-directional transmission of message(s). The activation is an encoded command which the lighting device 100 is configured to recognize and decode. The activation, once decoded, is what causes the lighting device 100 to transition to the operative state.

Having activated the lighting device 100, optionally the server 115 configures 515 the lighting device 100. The server 115 may be capable of configuring the lighting device 100 in accordance with the one or more desired parameters of the customer, as provided to the server 115 during the preliminary step described above. In various embodiments, the server 115 configures 515 the lighting device 100 by sending thereto one or more messages indicative of one or more desired parameters of the lighting device 100. The one or more messages may be transmitted over the secure communications channel, or 'in the clear'.

Other embodiments, and variants of the described embodiments, which fall within the scope of the claims will be apparent to the skilled person. For instance, in variants of the embodiments described with reference to FIG. 5, during purchase of the lighting device 100 the PoS terminal 120 obtains an identifier thereof and communicates it, along with an associated PoS "sale confirmed" message, to a remote database. As a result, the communications device 110 need not provide proof-of-purchase details to the server 115, and the user need not manually enter the proof-of-purchase details into wireless communications device 110 via a suitable user interface thereof. The lighting device may be configured to receive the activation, e.g. automatically after it is installed in a socket for use, from a remote server or from a nearby lighting device.

Suitable instructions for the methods herein may be stored/distributed on a suitable computer readable medium, such as an optical storage medium or a solid-state medium supplied together with or as part of other hardware, but may also be distributed via other computer program products such as Internet/intranet downloads or via other wired or wireless communication.

Figure 6:
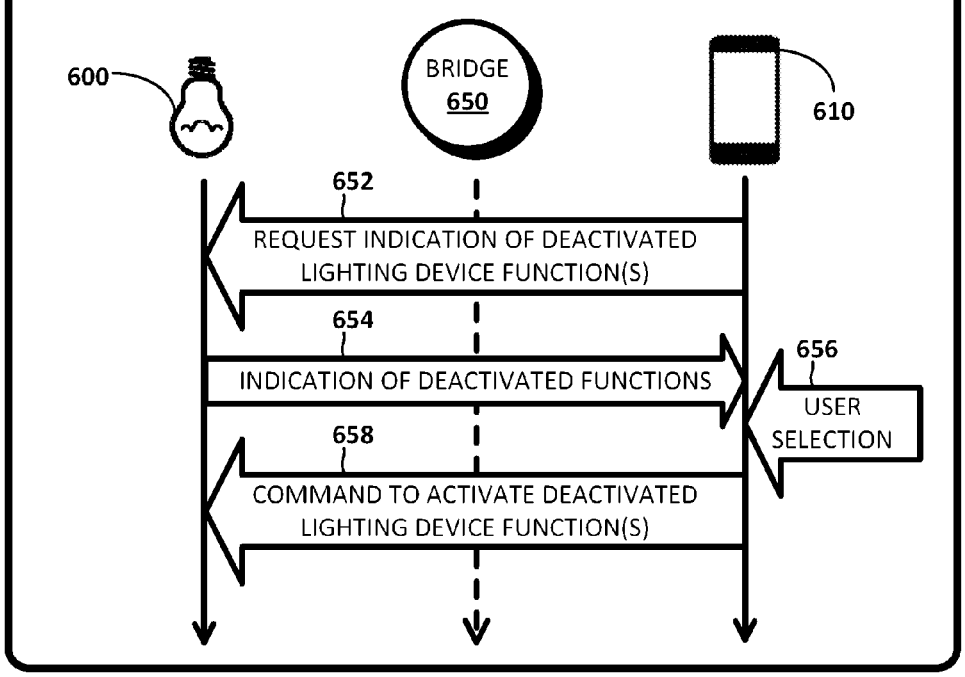

In another aspect, lighting devices may be configured to activate otherwise deactivated lighting device functions in response to various events and/or stimuli involving other lighting devices, lighting system bridges and/or mobile computing devices such as smart phones and/or tablet computers. Referring now to FIG. 6, a lighting device 600 configured with selected aspects of the present disclosure may be part of a lighting system (not depicted) under the control of a lighting system bridge 650. A wireless communication device 610, also referred to as "mobile computing device 610," may be in communication with lighting system bridge 650 and/or lighting device 600 over one or more networks (not depicted in FIG. 6, see network(s) 105 in FIG. 1).

At 652, mobile computing device 610 may ascertain one or more deactivated lighting device functions of lighting device 600. For example, in some embodiments, mobile computing device 610 may request, e.g., from lighting device 600, an indication of one or more deactivated lighting device functions of lighting device 600. This communication may occur using various wired or wireless mediums, and may be performed using various technologies, including but not limited to Wi-Fi, BlueTooth, ZigBee, coded light (e.g., visible or invisible light modulated with information), and so forth. As indicated by the dashed line under bridge 650, in some embodiments, this communication may be relayed through bridge 650, although this is not required and mobile computing device 610 may communicate directly with lighting device 600 as well.

At 654, lighting device 600 may provide, e.g., directly or through bridge 650, an indication of its deactivated lighting device functions. For example, lighting device 600 may provide, in various formats, a list of lighting characteristics it is capable of emitting, a list of lighting scenes it has at its disposal, a list of dynamic lighting sequences it is capable of emitting, a baby monitoring function, and so forth.

Upon receiving the indication of one or more deactivated lighting device functions from lighting device 600, mobile computing device 610 may render, e.g., on a touch screen, a user interface that presents to a user a graphical representation (e.g., pull down menu, list, etc.) of deactivated lighting device functions of lighting device 600. A user may select one or more of the deactivated lighting devices to be activated. In some embodiments, the user may be provided with the option to purchase activation of one or more lighting device functions, e.g., using a credit card or online bank account, or indirectly, by means of a user account that is coupled to a credit card or online bank account. In some embodiments, the user interface may be operable by the user to select a time interval for which the deactivated lighting device function will be activated. For example, the more the user spends, the longer the function will be activated.

Upon the user selecting and/or purchasing activation of one or more deactivated lighting device functions at 656, at 658, mobile computing device 610 may transmit to lighting device, directly or via bridge 650, a command to activate one or more user-selected deactivated lighting device functions. If the user designated a particular time interval for the lighting device function to be activated, then the command may include commands to first activate the deactivated lighting device function of lighting device 600, and then to deactivate the lighting device function after passage of the time interval. In some embodiments, the lighting device function may be deactivated after the predetermined time interval unless a lighting device function renewal communication is received, e.g., from bridge 650 or mobile computing device 610, during the time interval.

Figure 7:
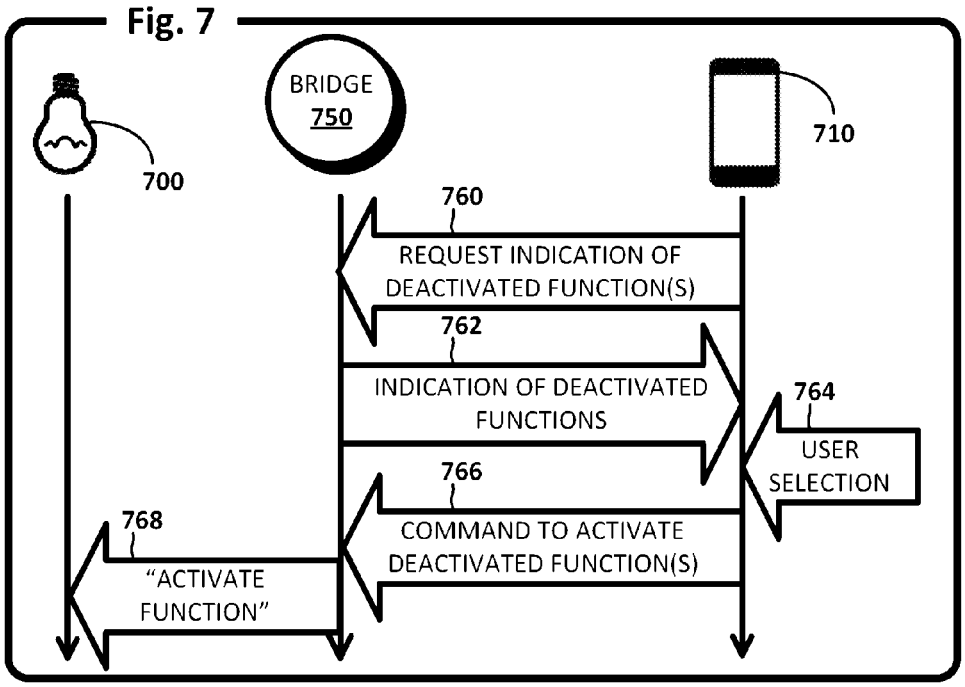

FIG. 7 depicts a slight variation of the scenario demonstrated by FIG. 6. Once again a lighting device 700 configured with selected aspects of the present disclosure is in communication with a lighting system bridge 750 and a mobile computing device 710 over one or more networks (not depicted). Many of the operations in FIG. 7 are similar to those in FIG. 6, except that instead of obtaining information about deactivated functions from lighting device 700 itself, mobile computing device 710 interacts with bridge 750.

At operation 760, mobile computing device 710 may request, e.g., from lighting system bridge 760, an indication of one or more deactivated lighting device functions of lighting device 600. In some embodiments, lighting system bridge 750 may maintain a database (not depicted) of lighting devices under its control, as well as lighting device functions (activated and deactivated) of those lighting devices. In other embodiments, lighting system bridge 750 may not maintain such a database, or at least as complete a database, and may instead inquire with lighting devices (e.g., 700) on the fly about their functionality when requested by a mobile computing device.

At 762, lighting system bridge 750 may provide to mobile computing device 710 an indication of one or more deactivated lighting device functions of lighting device 700. Mobile computing device 710 may respond by, e.g., rendering a user interface that depicts the available deactivated lighting device functions. As before, a user may select at 764 one or more of those functions to activate. At 766, mobile computing device 710 may transmit a command to lighting system bridge 750 to activate the one or more user-selected deactivated lighting device functions. At 768, lighting system bridge 750 may in turn command lighting device 700 to activate the one or more user-selected lighting device functions.

Rather than a user requesting (e.g., by purchasing) that a deactivated lighting device function be activated, in some embodiments, one or more deactivated lighting device functions may be activated based on a composition of a lighting system. For example, in FIG. 8, a first lighting device 800*a* configured with selected aspects of the present disclosure is being added to a lighting system controlled by a bridge 850. The lighting system already includes one or more lighting devices, including second lighting device 800*b*. Additionally, lighting system bridge 850 is in communication with a database 851 of one or more lighting device records associated with one or more lighting devices of the lighting system. In various embodiments, a lighting device record may exist for each lighting device that is associated with a lighting system.

Each lighting device record may include various information about a lighting device, including but not limited to an identifier (e.g., serial number, model number, etc.), an identity of a manufacturer or other entity that makes, sells, distributes and/or markets the lighting device, one or more characteristics of the lighting device (e.g., lumen output, size, shape, power requirements, etc.), an amount paid for the lighting device, and so forth. In some embodiments, a lighting device record may include information about one or more lighting device functions that the lighting device is capable of performing. As noted herein, those lighting device functions may include a variety of routines or state machines that may be performed by the lighting device, such as emitting predetermined lighting scenes, emitting light having various characteristics, operating as a touch- or noise-sensitive lighting device, operating as a baby monitoring lighting device, and so forth. In some such embodiments, the lighting device record may further include one or more indications of whether each lighting device function is activated or deactivated.

Database 851 and/or selected aspects of database 851 may be stored in memory associated with one or more components of the present disclosure. In some embodiments, database 851 is stored in memory of a mobile computing device (e.g., 110, 610, 710). In some embodiments, database 851 is stored in memory associated with a lighting system bridge (e.g., 650, 750, 850). In some embodiments, database 851 may be stored in memory of a remote computing device that is in communication with bridge 850 and/or one or more lighting devices (e.g., 800*a*, 800*b*) over one or more networks (e.g., 105 in FIG. 1). In some embodiments, database 851 may be stored across multiple components. In various embodiments, lighting device records in database 851 may be added, deleted and otherwise maintained by various components, such as lighting system bridge 850, a mobile computing device (e.g., 110, 610, 710), or another computing device.

In FIG. 8, when first lighting device 800*a* is added to the lighting system, it may send out a communication to bridge 850 and/or other components of the lighting system at 870. That communication may in some instances be a request to join the lighting system. In some embodiments, such a request may also include one or more indications of one or more activated and/or deactivated lighting device functions that first lighting device 800*a* is equipped to perform.

At 872, bridge 850 may add a lighting device record corresponding to first lighting device 800*a* to database 851. At 874, bridge 850 may request, from database 851, lighting device records of lighting devices that are associated with the lighting system under the control of lighting system bridge 850. At 876, database 851 may return lighting device records to bridge 850. It should be understood that many transactions described herein may be performed in a different order than shown. For example, 874 and 876 could occur prior to 872.

Once lighting system bridge 850 has the lighting device records associated with the lighting system it controls, lighting system bridge 850 may determine whether a composition of the lighting system satisfies one or more predetermined criterion. As used herein, a "composition" of a lighting system may refer to one or more of a number of lighting devices in the lighting system, the types of lighting devices in the lighting system, the capabilities (e.g., lighting device functions) of lighting devices in the lighting system, an amount of cumulative money spent on lighting devices in the lighting system, and so forth.

Various criteria may be used when determining whether a composition of a lighting system warrants activation or deactivation of one or more lighting device functions of one or more lighting devices. These criteria may include but are not limited to a threshold number of lighting devices being present in the lighting system, a threshold number of lighting devices associated with a particular entity (e.g., manufacturer, distributor retailer, etc.) being present in the lighting system, a threshold number of lighting devices having a particular lighting device function (e.g., capability of emitting various colors or sequences of colors, etc.) activated that are present in the lighting system, a threshold amount of money having been spent on lighting devices from a particular entity, and so forth.

Such functionality may be used, for instance, by manufacturers, retailers or other entities to reward customers for purchasing their products. Assume a user adds greater than a predetermined number of lighting devices sold by a particular retailer to his or her lighting system. A component of the light system, such as bridge 850, may determine that the composition of the lighting system satisfies a predetermined threshold of lighting devices from that retailer. Then, as shown in FIG. 8, a component of the lighting system, such as lighting system bridge 850, may transmit a command to one or more lighting devices (such as second lighting device 800*b*) at 878 to activate a particular lighting device function. In some cases, the more lighting devices that user purchases from that retailer (and installs in her lighting system), the more lighting device functions are "unlocked" (i.e., activated).

In some embodiments, in addition to or instead of lighting system bridge 850 determining that a lighting system composition satisfies a predetermined criterion, lighting devices may make such a determination. For instance, when a new lighting device is added, existing lighting devices may ascertain a composition of the lighting system, e.g., based on information stored in database 851. Each of those individual lighting devices may then make its own determination of whether the predetermined criterion is satisfied, and may activate one or more of its own lighting device functions accordingly.

An alternative scenario is depicted in FIG. 9. Again, a lighting device 900 configured with selected aspects of the present disclosure is being added to a lighting system. At 980, lighting device 900 transmits, e.g., to lighting system bridge 950, a communication requesting to join the lighting system, which as noted above may include other information about capabilities of lighting device 900, etc. At 982, lighting system bridge 950 may add a lighting device record to database 951. At 984, lighting system bridge 950 may request lighting device records from database 951, which lighting system bridge 950 may receive from database 951 at 986.

At 988, lighting system bridge 950 may transmit a communication to mobile computing device 910 to facilitate user operation of mobile computing device 910 to activate one or more deactivated lighting device functions of lighting device 900 or another lighting device (not depicted) that is associated with the lighting system. For example, the communication may cause mobile computing device 910 to render, e.g., on a touch screen, a user interface operable by a user to activate one or more deactivated lighting device functions of lighting device 900 or another lighting device associated with the lighting system. In some embodiments, mobile computing device 910 may selectively render various aspects of the user interface depending on a composition of the lighting system (e.g., based on information contained in the communication transmitted by lighting system bridge 950 to mobile computing device 910 at 988). For example, lighting device functions associated with a predetermined criterion that is not yet satisfied may be rendered as disabled icons, or not at all.

Between 988 and 990, a user may operate mobile computing device 910 to select one or more lighting device functions of lighting device 900 or another lighting device in the lighting system to activate (or deactivate). At 990, mobile computing device 910 may transmit a command to lighting device 900 (or to another lighting device, or to lighting system bridge 950) to activate one or more deactivated lighting device functions.

Figure 10:
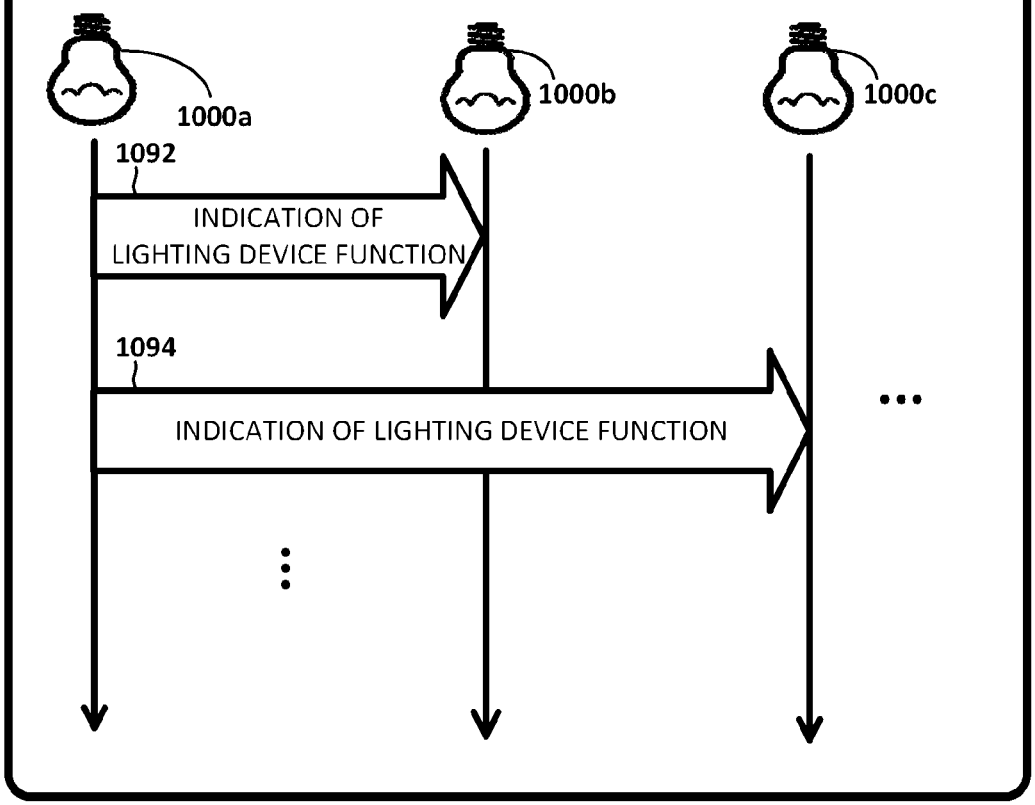

In some embodiments, function-specific lighting devices may communicate their lighting device functions directly to other lighting devices (or indirectly through a lighting system bridge), e.g., upon joining a lighting system. Other lighting devices with similar lighting device functions that perhaps are deactivated may, in response, activate those deactivated functions. For example, in FIG. 10, a first lighting device 1000*a* that is marketed to perform a particular lighting device function is being added to a lighting system. At 1092, first lighting device 1000*a* may transmit an indication of that marketed lighting device function to a second lighting device 1000*b* that is already associated with the lighting system. Second lighting device 1000*b* may then activate its own same or similar lighting device function.

Similarly, at 1094, first lighting device 1000*a* may transmit an indication of the marketed lighting device function it is capable of performing to a third lighting device 1000*c* associated with the lighting system. Third lighting device 1000*c* may respond similarly to second lighting device 1000*b* assuming third lighting device 1000*c* has the same or similar built in lighting device functionality. If a lighting device associated with a lighting system does not include the same or similar functionality, it may simply ignore the communication from first lighting device 1000*a*. Note that while 1092 and 1094 are depicted occurring one after the other, they may also occur simultaneously. In some embodiments, first lighting device 1000*a* may simply broadcast an indication of one or more lighting device functions it is capable of performing. In this manner, a user may activate a particular lighting device function at multiple lighting devices of a lighting system by purchasing another lighting device that has the desired lighting device function activated, and adding it to the lighting system.

In some embodiments, a mobile computing device (e.g., 110, 610, 710, 910) may be used concurrently by a user to indicate which lighting devices on which the desired lighting device function should be activated. Additionally, in some embodiments, the newly added lighting device 1000*a* may activate its own deactivated lighting device functions based on those that are already activated on already-installed lighting devices (e.g., 1000*b*, 1000*c*) of the lighting system.

In some embodiments, a lighting device configured with selected aspects of the present disclosure may be configured to temporarily activate lighting device functions, e.g., as a free trial provided by a coupon. This may be triggered, for instance, by the detection of a function trial identifier communicated by a lighting device. The function trial identifier may activate a particular lighting device function of one or more lighting devices associated with a lighting system for a predetermined time interval. Additionally or alternatively, instead of deactivating a lighting device function after a predetermined time interval, in some embodiments, a lighting device function may be deactivated after a specific amount of usage instances.

In some embodiments, activation/deactivation of a lighting device function may depend on one or more network characteristics of a lighting device. For instance, a lighting device may have domain restrictions that prevent the lighting device from being used to activate functions in multiple domains (e.g., businesses, homes, etc.). As an alternative, a function trial identifier may be valid, and a corresponding lighting device function may remain activated, only as long as the lighting device resides in the same domain as where the lighting device function was activated originally. Such a domain may be identified by a network prefix, a specific network device (e.g., lighting system bridge), and so forth.

In some embodiments, a composition of a lighting system may change, which may prompt deactivation of one or more lighting device functions. For instance, a lighting device may be configured to deactivate one or more lighting device functions upon determination that a composition of a lighting system with which the lighting device is associated no longer satisfies a predetermined criterion.

As another example, in some embodiments, a lighting device may be configured to deactivate one or more lighting device functions upon determination that a state of a removable component which may be attached to the lighting device or to another component of the same lighting system has been altered (e.g., a USB dongle has been added or removed). For example, a removable component may include a sensor such as a motion, touch or sound sensor. Addition of that component to a lighting device may cause that lighting device to enable a lighting device function for emitting light in response to detecting movement, touch, or noise. In some embodiments, addition of such a component may enable other lighting device functions, such as a particular dynamic lighting function that may otherwise not be available to the user.

In some embodiments, a lighting device may be configured to perform secure upgrades, e.g., by making a function activation identifier or application software lighting device-specific. For example, a function activation identifier or application software may be encoded, and may be decoded only with a key available in a specific lighting device. An example is the use of asymmetric key pairs: one key (the public key) (e.g. a service provider site) may be used to encode the identifier or software. The other (private) key may be stored in memory available to the lighting device, and may be used for decoding. The key pair may be specific for the lighting device. In some embodiments, instead of encrypting the identifier or software, the asymmetric key pair may be used to verify a signature, whereby a certificate is the "information" that unlocks the additional functionality and it is signed by a signature. In such case, the private key may be used by the service provider to create a signature that may be used to sign the certificate to activate one or more deactivated lighting device functions. The lighting device may check the signature (e.g., using a public key) on the certificate to verify that the signature was provided by a particular entity.

In various embodiments, one or more deactivated lighting device functions may be recommended to a user in various ways. For instance, a mobile computing device or lighting system bridge may determine a composition of a lighting system. It may then determine whether the composition satisfies one or more predetermined criteria. If the answer is yes, then the mobile computing device may recommend (e.g., by rendering a message on a touch screen display) one or more lighting device functions to a user, e.g., for purchase or for temporary use as a trial.

In some embodiments, the mobile computing device or another computing device (e.g., a lighting system bridge) may recommend lighting device functions based on analyzed usage or sensor data. For example, one or more lighting devices detecting sounds typically associated with children (e.g., a baby crying) may trigger a lighting system bridge and/or mobile computing device to recommend a kids-related lighting device function, such as a baby monitor. Similarly, if no lighting device detects motion for a predetermined time interval, a presence-simulating lighting device function (e.g., a predetermined lighting sequence that is emitted to give the impression that someone is home) may be recommended to a user, or even automatically activated.

Figure 11:
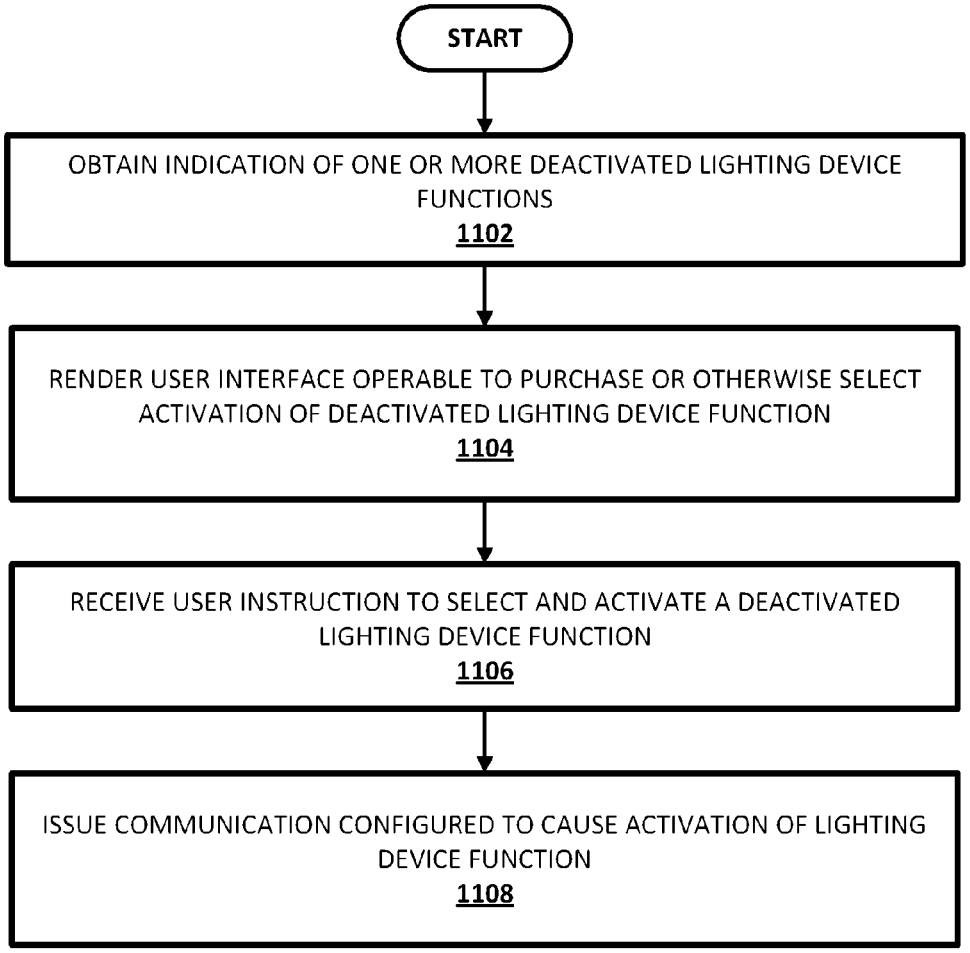
FIG. 11 depicts an example method that may be implemented by a lighting device, in accordance with various embodiments.

FIG. 11 depicts one example method 1100 that may be implemented by a mobile computing device, in accordance with various embodiments. At block 1102, the mobile computing device may obtain indication of one or more deactivated lighting device functions of one or more lighting devices. For instance, the mobile computing device may obtain this information from a database (e.g., 851, 951), from a lighting system bridge, or even a lighting device.

At block 1104, the mobile computing device may render a user interface that is operable to purchase or otherwise select one or more lighting device functions for activation. For example, the mobile computing device may render a drop down menu that includes a list of the deactivated functions obtained at block 1102. At 1106, the mobile computing device may receive the user's selection of one or more of those lighting device functions for activation, in exchange for money or otherwise. At block 1108, the mobile computing device may issue a communication, e.g., directly to a lighting device or to a lighting system bridge, to cause activation of the user-selected lighting device function.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

It should also be understood that, unless clearly indicated to the contrary, in any methods claimed herein that include more than one step or act, the order of the steps or acts of the method is not necessarily limited to the order in which the steps or acts of the method are recited.

Reference numerals appearing in the claims between parentheses, if any, are provided merely for convenience and should not be construed as limiting the claims in any way.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. A computing device, comprising:

one or more processors;

a communication interface coupled with the one or more processors; and memory to store instructions that, in response to execution of the instructions by the one or more processors, cause the one or more processors to:

ascertain, based at least in part on a database of one or more lighting device records associated with one or more lighting devices of a lighting system, a composition of the lighting system;

determine, based on the ascertained composition, that a predetermined criterion is satisfied; and issue, via the communication interface in response to the determination, a communication configured to facilitate activation of a deactivated lighting device function of a lighting device associated with the lighting system, wherein the deactivated lighting device function is a routine or state machine that is built into the lighting device, but that is not performable until activated.

2. The computing device of claim 1, wherein the predetermined criterion comprises a threshold number of lighting devices present in the lighting system, or a threshold number of lighting devices associated with a particular entity present in the lighting system.

3. The computing device of claim 1, wherein the predetermined criterion comprises a threshold number of lighting devices having a particular lighting device function activated that are present in the lighting system.

4. The computing device of claim 3, wherein the particular lighting device function comprises a baby monitoring function, a security monitoring function, a user-input detecting function, an intercom function, a Wi-Fi repeater function, a wake up light effect function, a nightlight function, an info-light function, an environmental parameter-sensing function, an audio rendering or recording function, or a speech recognition function.

5. The computing device of claim 1, wherein the memory further stores the database of one or more lighting device records.

6. The computing device of claim 1, wherein the memory further stores instructions that, in response to execution of the instructions by the one or more processors, cause the one or more processors to transmit the communication to a remote computing device, and wherein the communication facilitates user operation of the remote computing device to activate the deactivated lighting device function.

7. The computing device of claim 6, wherein the remote computing device comprises:

a mobile computing device, and the communication is configured to cause the mobile computing device to render a user interface operable by a user to activate the deactivated lighting device function;

a lighting system bridge that controls the lighting system;

another lighting device associated with the lighting system.

8. The computing device of claim 1, wherein the memory further stores instructions that, in response to execution of the instructions by the one or more processors, cause the one or more processors to transmit the communication to the lighting device associated with the lighting system or a lighting system bridge that controls the lighting system, and wherein the communication comprises a command to activate the deactivated lighting device function.

9. The computing device of claim 8, wherein the memory further stores instructions that, in response to execution of the instructions by the one or more processors, cause the one or more processors to render a user interface operable by a user to purchase activation of the deactivated lighting device function of the lighting device.

10. The computing device of claim 9, wherein the memory further stores instructions that, in response to execution of the instructions by the one or more processors, cause the one or more processors to update the database to reflect activation of the deactivated lighting device function.

11. A computer-implemented method, comprising:

obtaining, by a mobile computing device via a wireless communication interface, an indication of one or more deactivated lighting device functions of a lighting device;

receiving, by the mobile computing device via a user interface of the mobile computing device, a user instruction to select and activate a deactivated lighting device function of the lighting device; and issuing, by the mobile computing device via the wireless communication interface, a communication configured to cause activation of the deactivated lighting device function of the lighting device, wherein the deactivated lighting device function is a routine or state machine that is built into the lighting device, but that is not performable until activated.

12. The computer-implemented method of claim 11, wherein the issuing comprises transmitting, by the mobile computing device to the lighting device or a lighting system bridge in communication with the lighting device, a command to activate the deactivated lighting device function of the lighting device.

13. The computer-implemented method of claim 11, further comprising rendering, on a touch screen of the mobile computing device, a user interface operable by a user to purchase activation of the deactivated lighting device function of the lighting device.

14. The computer-implemented method of claim 13, wherein the user interface is further operable by the user to select a time interval for which the deactivated lighting device function will be activated, and wherein the issuing comprises transmitting, by the mobile computing device to the lighting device or a lighting system bridge in communication with the lighting device, commands to activate the deactivated lighting device function of the lighting device and then deactivate the lighting device function after passage of the time interval.

15. The computer-implemented method of claim 11, wherein obtaining the indication of one or more deactivated lighting device functions of the lighting device comprises one of:

receiving, by the mobile computing device directly from the lighting device, the indication of one or more deactivated lighting device functions of the lighting device; or obtaining, by the mobile computing device from a lighting system bridge in communication with the lighting device, the indication of one or more deactivated lighting device functions of the lighting device.

16. The computer-implemented method of claim 11, wherein obtaining the indication of one or more deactivated lighting device functions of the lighting device comprises obtaining, by the mobile computing device from a lighting system bridge in communication with the lighting device, the indication of one or more deactivated lighting device functions of the lighting device.

17. The computer-implemented method of claim 11, wherein obtaining the indication of one or more deactivated lighting device functions of the lighting device comprises obtaining, from a database of one or more lighting device records associated with one or more lighting devices of a lighting system, a composition of the lighting system.

18. The computer-implemented method of claim 17, wherein the database is stored in memory of the mobile computing device.

19. A lighting device, comprising:

one or more LED-based light sources;

a communication interface; and a controller operably coupled with the one or more LED-based light sources and the communication interface, the controller configured to:

ascertain, based at least in part on a database of one or more lighting device records associated with one or more lighting devices of a lighting system with which the lighting device is associated, a composition of the lighting system;

determine, based on the ascertained composition, that a predetermined criterion is satisfied; and activate a deactivated lighting device function of the lighting device in response to the determination, wherein the deactivated lighting device function is a routine or state machine that is built into the lighting device, but that is not performable until activated.

20. The lighting device of claim 19, wherein the controller is further configured to:

provide, to another lighting device via the communication interface, a command to activate the same deactivated lighting device function on the another lighting device;

deactivate the lighting device function after a predetermined time interval;

deactivate the lighting device function after a predetermined time interval unless a lighting device function renewal communication is received via the communication interface during the time interval;

deactivate the lighting device function upon determination that a network characteristic of the lighting device has been altered;

deactivate the lighting device function upon determination that the composition of the lighting system no longer satisfies the predetermined criterion; or deactivate the lighting device function upon determination that a state of a dongle has been altered.

* * * * *